US012180955B2

(12) United States Patent
Jeong et al.

(10) Patent No.: US 12,180,955 B2
(45) Date of Patent: Dec. 31, 2024

(54) OIL FEEDER AND LINEAR COMPRESSOR INCLUDING THE SAME

(71) Applicant: LG Electronics Inc., Seoul (KR)

(72) Inventors: Sangsub Jeong, Seoul (KR); Sungchul Gong, Seoul (KR); Seongyeol Hyun, Seoul (KR)

(73) Assignee: LG Electronics Inc., Seoul (KR)

( * ) Notice: Subject to any disclaimer, the term of this patent is extended or adjusted under 35 U.S.C. 154(b) by 44 days.

(21) Appl. No.: 18/101,354

(22) Filed: Jan. 25, 2023

(65) Prior Publication Data

US 2023/0332597 A1 Oct. 19, 2023

(30) Foreign Application Priority Data

Apr. 14, 2022 (KR) ..... 10-2022-0046249

(51) Int. Cl.
*F04B 53/18* (2006.01)
*F04B 9/06* (2006.01)
(Continued)

(52) U.S. Cl.
CPC ..... *F04B 53/18* (2013.01); *F04B 35/045* (2013.01); *F04B 39/0005* (2013.01); *F04B 9/06* (2013.01);
(Continued)

(58) Field of Classification Search
CPC .... F04B 53/18; F04B 35/045; F04B 39/0005; F04B 9/06; F04B 39/02; F04B 39/0261;
(Continued)

(56) References Cited

U.S. PATENT DOCUMENTS 1,325,773 A 12/1919 Babendreer
6,089,352 A 7/2000 Kim et al.
(Continued)

FOREIGN PATENT DOCUMENTS

CN 205938467 * 2/2017 ..... F04B 39/02
DE 19909302 7/2000
(Continued)

OTHER PUBLICATIONS

CN205938467 translation (Year: 2024).*
(Continued)

*Primary Examiner* — David N Brandt
(74) *Attorney, Agent, or Firm* — Fish & Richardson P.C.

(57) ABSTRACT

An oil feeder and a linear compressor including the same are disclosed. The oil feeder includes an oil cylinder defining an oil supply hole configured to extend in a first direction, an accommodation groove formed concavely at a side, and a communication hole configured to communicate the oil supply hole with the accommodation groove, an oil piston accommodated in the accommodation groove and configured to reciprocate in a second direction perpendicular to the first direction, a first ball accommodated in the oil supply hole and disposed below the communication hole, a second ball accommodated in the oil supply hole and disposed on the communication hole, and an elastic member comprising an outer portion coupled to the accommodation groove and an inner portion coupled to the oil piston.

18 Claims, 10 Drawing Sheets

(51) Int. Cl.

| | |
|---|---|
| ***F04B 35/04*** | (2006.01) |
| ***F04B 39/00*** | (2006.01) |
| ***F04B 39/02*** | (2006.01) |
| ***F04B 39/10*** | (2006.01) |
| ***F04B 39/12*** | (2006.01) |
| ***F04B 39/14*** | (2006.01) |
| ***F04B 53/10*** | (2006.01) |
| ***F04B 53/22*** | (2006.01) |

(52) U.S. Cl.
CPC ..... *F04B 39/0261* (2013.01); *F04B 39/0276* (2013.01); *F04B 39/0292* (2013.01); *F04B 39/1006* (2013.01); *F04B 39/125* (2013.01); *F04B 39/14* (2013.01); *F04B 53/1005* (2013.01); *F04B 53/22* (2013.01)

(58) Field of Classification Search
CPC ..... F04B 39/0276; F04B 39/0292; F04B 39/1006; F04B 39/125; F04B 39/14; F04B 53/1005; F04B 53/22; F04B 39/0207; F05B 2260/98
See application file for complete search history.

(56) References Cited

U.S. PATENT DOCUMENTS

| | | | | |
|---|---|---|---|---|
| 6,299,421 | B1 * | 10/2001 | Oh | F04B 35/045 417/571 |
| 7,802,656 | B2 * | 9/2010 | Macklin | F16N 7/12 384/409 |
| 2001/0014292 | A1 * | 8/2001 | Kawahara | F04B 35/045 417/417 |

FOREIGN PATENT DOCUMENTS

| | | | | |
|---|---|---|---|---|
| JP | 3229608 | | 11/2001 | |
| KR | 20000039162 | * | 7/2000 | F04B 35/045 |
| KR | 10-0845943 | | 7/2008 | |
| KR | 10-2009-0041731 | | 4/2009 | |
| KR | 10-2009-0053130 | | 5/2009 | |
| KR | 20090095113 | | 9/2009 | |

OTHER PUBLICATIONS

Merriam-webster.com; Concave Definition & Meaning—Merriam-Webster pdf from merriam-webster.com/dictionary/concave (Year: 2024).*
KR20000039162 translation (Year: 2024).*
Extended European Search Report in European Appln. No. 23154820.7, mailed on Oct. 2, 2023, 5 pages.
Notice of Allowance in Korean Appln. No. 10-2022-0046249, mailed on Dec. 5, 2023, 4 pages (with English translation).

* cited by examiner

OIL FEEDER AND LINEAR COMPRESSOR INCLUDING THE SAME

CROSS-REFERENCE TO RELATED APPLICATIONS

This application claims the benefit of Korea Patent Application No. 10-2022-0046249, filed on Apr. 14, 2022, which is incorporated herein by reference for all purposes as if fully set forth herein.

TECHNICAL FIELD

The present disclosure relates to an oil feeder and a linear compressor including the same.

BACKGROUND

In general, a compressor refers to a device that is configured to receive power from a power generator such as a motor or a turbine and compress a working fluid such as air or refrigerant. More specifically, the compressors are widely used in the whole industry or home appliances, such as for a steam compression refrigeration cycle (hereinafter, referred to as "refrigeration cycle").

The compressors may be classified into a reciprocating compressor, a rotary compressor, and a scroll compressor according to a method of compressing the refrigerant.

The reciprocating compressor uses a method in which a compression space is formed between a piston and a cylinder, and the piston linearly reciprocates to compress a fluid. The rotary compressor uses a method of compressing a fluid by a roller that eccentrically rotates inside a cylinder. The scroll compressor uses a method of compressing a fluid by engaging and rotating a pair of spiral scrolls.

Recently, among the reciprocating compressors, the use of linear compressors that uses a linear reciprocating motion without using a crank shaft is gradually increasing. The linear compressor has advantages in that it has less mechanical loss resulting from switching a rotary motion to the linear reciprocating motion and thus can improve the efficiency, and has a relatively simple structure.

The linear compressor is configured such that a cylinder is positioned in a casing forming a sealed space to form a compression chamber, and a piston covering the compression chamber reciprocates in the cylinder. The linear compressor repeats a process in which a fluid in the sealed space is sucked into the compression chamber while the piston is positioned at a bottom dead center (BDC), and the fluid of the compression chamber is compressed and discharged while the piston is positioned at a top dead center (TDC).

A compression unit and a drive unit are installed inside the linear compressor. The compression unit performs a process of compressing and discharging a refrigerant while performing a resonant motion by a resonant spring through a movement generated in the drive unit.

The piston of the linear compressor repeatedly performs a series of processes of sucking the refrigerant into the casing through an intake pipe while reciprocating at high speed inside the cylinder by the resonant spring, and then discharging the refrigerant from a compression space through a forward movement of the piston to move it to a condenser through a discharge pipe.

The linear compressor may be classified into an oil lubricated linear compressor and a gas lubricated linear compressor according to a lubrication method.

The oil lubricated linear compressor is configured to store a predetermined amount of oil in the casing and lubricate between the cylinder and the piston using the oil.

On the other hand, the gas lubricated linear compressor is configured not to store an oil in the casing, induce a part of the refrigerant discharged from the compression space between the cylinder and the piston, and lubricate between the cylinder and the piston by a gas force of the refrigerant.

The oil lubricated linear compressor supplies the oil of a relatively low temperature between the cylinder and the piston and thus can suppress the cylinder and the piston from being overheated by motor heat or compression heat, etc. Hence, the oil lubricated linear compressor suppresses specific volume from increasing as the refrigerant passing through an intake flow path of the piston is sucked into the compression chamber of the cylinder and is heated, and thus can prevent in advance an intake loss from occurring.

FIG. 10 is a cross-sectional view of an oil feeder according to a related art.

Referring to FIG. 10, an oil feeder 10 according to a related art includes an oil cylinder 11, an oil piston 12 that linearly reciprocates inside the oil cylinder 11 in an axial direction or a horizontal direction, first and second elastic members 13 and 14 supporting the oil piston 12, an intake valve 15 coupled to a front end of the oil piston 12, and a discharge valve 16 that is coupled to the oil cylinder 11 and is disposed at a front end of the intake valve 15.

The oil stored in a bottom surface of a shell according to a vibration of the oil piston 12 passes through a first flow path 17, the inside of the oil piston 12, the intake valve 15, the discharge valve 16, and a second flow path 18 and is supplied between the piston and the cylinder.

Since the oil feeder 10 according to the related art was extended in the axial direction or the horizontal direction, there was a problem in that a length of the linear compressor was increased.

SUMMARY

An object of the present disclosure is to provide an oil feeder and a linear compressor including the same capable of reducing an axial length or a horizontal length of the linear compressor by reducing an axial length of the oil feeder.

Another object of the present disclosure is to provide an oil feeder and a linear compressor including the same capable of improving the ease of assembly of first ball and the second ball with respect to the oil feeder by inserting the first ball into an oil supply hole and then inserting the second ball into the oil supply hole.

Another object of the present disclosure is to provide an oil feeder and a linear compressor including the same capable of allowing a first ball to stably move in a vertical direction while stably supporting the first ball.

Another object of the present disclosure is to provide an oil feeder and a linear compressor including the same capable of allowing a second ball to stably move in a vertical direction while stably supporting the second ball.

Another object of the present disclosure is to provide an oil feeder and a linear compressor including the same capable of enabling a stable vertical movement of a first ball and a second ball according to vibration of an oil piston.

Another object of the present disclosure is to provide an oil feeder and a linear compressor including the same capable of reducing a friction between an oil piston and an oil cylinder due to oil stored in a groove between the oil piston and the oil cylinder.

Another object of the present disclosure is to provide an oil feeder and a linear compressor including the same capable of improving the ease of assembly of an oil piston and an elastic member by assembling a coupling groove exposed to the outside and the elastic member using a fastening member.

Another object of the present disclosure is to provide an oil feeder and a linear compressor including the same capable of improving structural stability of the oil feeder by preventing an outer portion of an elastic member from moving to an accommodation space.

Another object of the present disclosure is to provide an oil feeder and a linear compressor including the same capable of reducing interference between an elastic member and a connection area when the elastic member is deformed due to vibration of an oil piston.

Another object of the present disclosure is to provide an oil feeder and a linear compressor including the same capable of improving the ease of coupling of a fixing member to an oil cylinder while stably fixing an outer portion of an elastic member to the oil cylinder.

Another object of the present disclosure is to provide an oil feeder and a linear compressor including the same capable of reducing the size of the linear compressor by coupling the oil feeder to a flange portion of a frame.

Another object of the present disclosure is to provide an oil feeder and a linear compressor including the same capable of improving space efficiency of the linear compressor.

Another object of the present disclosure is to provide an oil feeder and a linear compressor including the same capable of enabling stable coupling of the oil feeder to a flange portion of a frame.

Another object of the present disclosure is to provide an oil feeder and a linear compressor including the same capable of improving the ease of assembly of the oil feeder by guiding a coupling position of the oil feeder with respect to a flange portion.

Another object of the present disclosure is to provide an oil feeder and a linear compressor including the same capable of compensating for an assembly tolerance between a flange portion and the oil feeder.

To achieve the above-described and other objects, in one aspect of the present disclosure, there is provided an oil feeder comprising an oil cylinder comprising an oil supply hole configured to extend in a first direction, an accommodation groove formed concavely at a side, and a communication hole configured to communicate the oil supply hole with the accommodation groove, an oil piston accommodated in the accommodation groove and configured to reciprocate in a second direction perpendicular to the first direction, a first ball accommodated in the oil supply hole and disposed below the communication hole, a second ball accommodated in the oil supply hole and disposed on the communication hole, and an elastic member comprising an outer portion coupled to the accommodation groove and an inner portion coupled to the oil piston.

Hence, the present disclosure can reduce an axial length or a horizontal length of the linear compressor by reducing an axial length of the oil feeder. That is, the linear compressor can be made smaller.

The oil supply hole may comprise a first oil supply hole configured to communicate with the communication hole, a second oil supply hole disposed below the first oil supply hole and having an inner diameter less than an inner diameter of the first oil supply hole, and a third oil supply hole disposed on the first oil supply hole and having an inner diameter greater than the inner diameter of the first oil supply hole.

In this case, a diameter of the first ball may be less than a diameter of the second ball.

Hence, the present disclosure can improve the ease of assembly of the first ball and the second ball with respect to the oil feeder by inserting the first ball into the oil supply hole and then inserting the second ball into the oil supply hole.

The oil supply hole may further comprise a first connection portion configured to connect the first oil supply hole and the second oil supply hole and contact the first ball.

In this case, the first connection portion may have a decreasing inner diameter as it goes downward, and may be formed concavely inward.

Hence, the present disclosure can allow the first ball to stably move in a vertical direction while stably supporting the first ball.

The oil supply hole may further comprise a second connection portion configured to connect the first oil supply hole and the third oil supply hole and contact the second ball.

In this case, the second connection portion may have a decreasing inner diameter as it goes downward, and may be formed concavely inward.

Hence, the present disclosure can allow the second ball to stably move in the vertical direction while stably supporting the second ball.

In an initial state, the first ball and the second ball may entirely overlap the oil piston in the first direction.

Hence, the present disclosure can enable a stable vertical movement of the first ball and the second ball according to vibration of the oil piston.

The oil piston may comprise a groove formed on an outer circumferential surface facing an inner wall of the oil cylinder.

Hence, the present disclosure can reduce a friction between the oil piston and the oil cylinder due to oil stored in a groove between the oil piston and the oil cylinder.

The oil piston may comprise a coupling groove formed on a surface facing the elastic member, and the inner portion of the elastic member and the coupling groove may be penetrated by a fastening member.

Hence, the present disclosure can improve the ease of assembly of the oil piston and the elastic member by assembling a coupling groove exposed to the outside and the elastic member using the fastening member.

The accommodation groove may comprise an accommodation space in which the oil piston is disposed, and a coupling area that is disposed outside the accommodation space and is coupled to the outer portion of the elastic member, and an inner diameter of the coupling area may be greater than an inner diameter of the accommodation space.

Hence, the present disclosure can improve structural stability of the oil feeder by preventing the outer portion of the elastic member from moving to the coupling area.

The accommodation groove may further comprise a connection area configured to connect the accommodation space and the coupling area, and the connection area may be formed concavely inward.

Hence, the present disclosure can reduce interference between the elastic member and the connection area when the elastic member is deformed due to vibration of an oil piston.

The oil feeder may further comprise a fixing member configured to fix the outer portion of the elastic member to the oil cylinder, and the fixing member may be press-fitted and coupled to the accommodation groove.

Hence, the present disclosure can improve the ease of coupling of the fixing member to the oil cylinder while stably fixing the outer portion of the elastic member to the oil cylinder.

To achieve the above-described and other objects, in another aspect of the present disclosure, there is provided a linear compressor comprising a shell, a frame disposed in the shell, the frame comprising a body portion and a flange portion configured to extend radially from a front area of the body portion, a cylinder fixed to the body portion, a piston disposed in the cylinder and configured to reciprocate axially, and an oil feeder coupled to the flange portion and configured to supply an oil stored in a bottom surface of the shell to between the cylinder and the piston.

In this case, the present disclosure can reduce size of the linear compressor by coupling the oil feeder to the flange portion.

The linear compressor may further comprise an inner stator fixed to an outer circumferential surface of the cylinder, an outer stator fixed to a rear surface of the flange portion, and a permanent magnet disposed between the inner stator and the outer stator and connected to the piston.

In this case, the oil feeder may overlap the outer stator in the second direction.

Hence, the present disclosure can improve space efficiency of the linear compressor.

The linear compressor may further comprise a discharge valve coupled to the cylinder and disposed in a front of the piston.

In this case, the oil feeder may overlap the discharge valve in the first direction.

Hence, the present disclosure can improve space efficiency of the linear compressor.

The flange portion may comprise a front portion, a rear portion disposed at a rear of the front portion, and an oil hole disposed between the front portion and the rear portion and configured to communicate with the oil supply hole.

In this case, an upper surface of the oil cylinder may contact an outer end of the front portion, and a rear surface of the oil cylinder may contact a front surface of the rear portion.

The flange portion may comprise a first horizontal portion extending rearward from an outer end of the rear portion, and a vertical portion extending radially outward from a rear end of the first horizontal portion. The rear surface of the oil cylinder may contact a front surface of the vertical portion.

Hence, the present disclosure can enable stable coupling of the oil feeder to the flange portion.

The linear compressor may further comprise a discharge cover coupled to a front end of the cylinder. The oil cylinder may comprise a protrusion configured to protrude upward from an upper surface, and the protrusion may be inserted into a space between the discharge cover and the front portion.

Hence, the present disclosure can improve the ease of assembly of the oil feeder by guiding a coupling position of the oil feeder with respect to the flange portion.

The flange portion may comprise a second horizontal portion configured to extend forward from an inner end of the front portion and contact a rear surface of the discharge cover, and an upper end of the protrusion may be disposed adjacent to the second horizontal portion.

Hence, the present disclosure can compensate for an assembly tolerance between the flange portion and the oil feeder.

The present disclosure can provide an oil feeder and a linear compressor including the same capable of reducing an axial length or a horizontal length of the linear compressor by reducing an axial length of the oil feeder.

The present disclosure can provide an oil feeder and a linear compressor including the same capable of improving the ease of assembly of first ball and the second ball with respect to the oil feeder by inserting the first ball into an oil supply hole and then inserting the second ball into the oil supply hole.

The present disclosure can provide an oil feeder and a linear compressor including the same capable of allowing a first ball to stably move in a vertical direction while stably supporting the first ball.

The present disclosure can provide an oil feeder and a linear compressor including the same capable of allowing a second ball to stably move in a vertical direction while stably supporting the second ball.

The present disclosure can provide an oil feeder and a linear compressor including the same capable of enabling a stable vertical movement of a first ball and a second ball according to vibration of an oil piston.

The present disclosure can provide an oil feeder and a linear compressor including the same capable of reducing a friction between an oil piston and an oil cylinder due to oil stored in a groove between the oil piston and the oil cylinder.

The present disclosure can provide an oil feeder and a linear compressor including the same capable of improving the ease of assembly of an oil piston and an elastic member by assembling a coupling groove exposed to the outside and the elastic member using a fastening member.

The present disclosure can provide an oil feeder and a linear compressor including the same capable of improving structural stability of the oil feeder by preventing an outer portion of an elastic member from moving to an accommodation space.

The present disclosure can provide an oil feeder and a linear compressor including the same capable of reducing interference between an elastic member and a connection area when the elastic member is deformed due to vibration of an oil piston.

The present disclosure can provide an oil feeder and a linear compressor including the same capable of improving the ease of coupling of a fixing member to an oil cylinder while stably fixing an outer portion of an elastic member to the oil cylinder.

The present disclosure can provide an oil feeder and a linear compressor including the same capable of reducing the size of the linear compressor by coupling the oil feeder to a flange portion of a frame.

The present disclosure can provide an oil feeder and a linear compressor including the same capable of improving space efficiency of the linear compressor.

The present disclosure can provide an oil feeder and a linear compressor including the same capable of enabling stable coupling of the oil feeder to a flange portion of a frame.

The present disclosure can provide an oil feeder and a linear compressor including the same capable of improving the ease of assembly of the oil feeder by guiding a coupling position of the oil feeder with respect to a flange portion.

The present disclosure can provide an oil feeder and a linear compressor including the same capable of compensating for an assembly tolerance between a flange portion and the oil feeder.

BRIEF DESCRIPTION OF THE DRAWINGS

The accompanying drawings, which are included to provide a further understanding of the present disclosure and constitute a part of the detailed description, illustrate embodiments of the present disclosure and serve to explain technical features of the present disclosure together with the description.

DETAILED DESCRIPTION

Reference will now be made in detail to embodiments of the present disclosure, examples of which are illustrated in the accompanying drawings. Wherever possible, the same reference numbers will be used throughout the drawings to refer to the same or like parts.

It should be understood that when a component is described as being "connected to" or "coupled to" other component, it may be directly connected or coupled to the other component or intervening component(s) may be present.

It will be noted that a detailed description of known arts will be omitted if it is determined that the detailed description of the known arts can obscure embodiments of the present disclosure. The accompanying drawings are used to help easily understand various technical features and it should be understood that embodiments presented herein are not limited by the accompanying drawings. As such, the present disclosure should be understood to extend to any alterations, equivalents and substitutes in addition to those which are particularly set out in the accompanying drawings.

In addition, a term of "disclosure" may be replaced by document, specification, description, etc.

Figure 1:
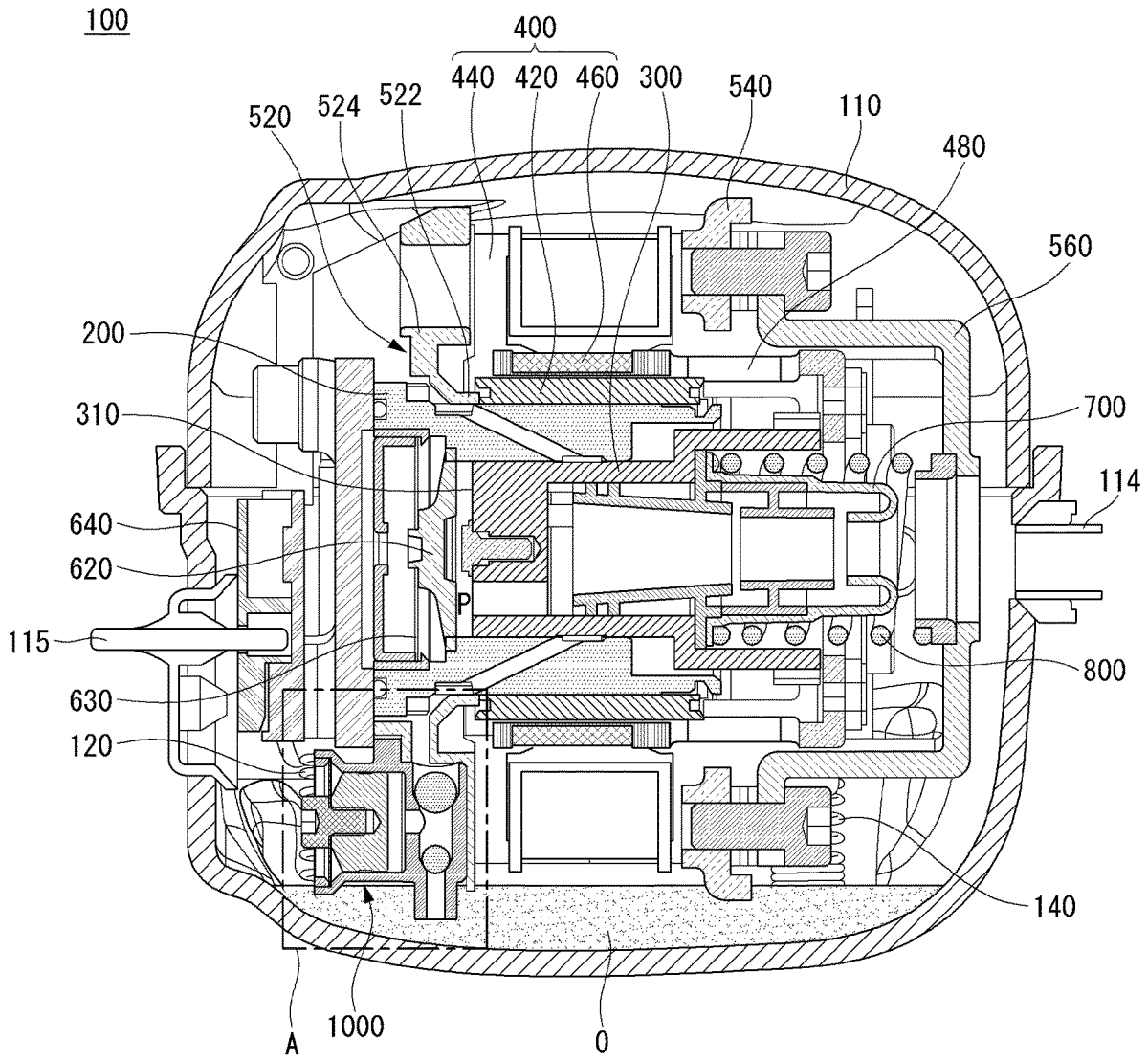
FIG. 1 is a cross-sectional view of a linear compressor according to an embodiment of the present disclosure.

FIG. 1 is a cross-sectional view of a linear compressor according to an embodiment of the present disclosure.

Hereinafter, a linear compressor according to the present disclosure will be described taking, as an example, a linear compressor 100 that sucks and compresses a fluid while a piston linearly reciprocates, and discharges the compressed fluid.

The linear compressor 100 may be a component of a refrigeration cycle, and a fluid compressed in the linear compressor 100 may be a refrigerant circulating the refrigeration cycle. The refrigeration cycle may include a condenser, an expander, an evaporator, etc., in addition to the compressor. The linear compressor 100 may be used as a component of a cooling system of a refrigerator, but is not limited thereto. The linear compressor 100 can be widely used in the whole industry.

Referring to FIG. 1, the linear compressor 100 may include a shell 110 and a main body accommodated in the shell 110. The main body of the linear compressor 100 may include a frame 520, a cylinder 200 fixed to the frame 520, a piston 300 that linearly reciprocates inside the cylinder 200, a drive unit 400 that is fixed to the frame 520 and gives a driving force to the piston 300, and the like. Here, the cylinder 200 and the piston 300 may be referred to as compression units 200 and 300.

The shell 110 may include a lower shell and an upper shell coupled to an upper part of the lower shell. The inside of the shell 110 may form a closed space. Further, the upper shell and the lower shell may be integrally formed.

The shell 110 may be formed of a thermally conductive material. Hence, heat generated in an inner space of the shell 110 can be quickly dissipated to the outside.

A leg (not shown) may be coupled to a lower side of the shell 110. The leg may be coupled to a base of a product in which the linear compressor 100 is installed. For example, the product may include a refrigerator, and the base may include a machine room base of the refrigerator. As another example, the product may include an outdoor unit of an air conditioner, and the base may include a base of the outdoor unit.

The shell 110 may have substantially a cylindrical shape and may be disposed to lie in a horizontal direction or an axial direction. FIG. 1 illustrates that the shell 110 is extended in the horizontal direction and has a slightly low height in a radial direction, by way of example. That is, since the linear compressor 100 can have a low height, there is an advantage in that a height of the machine room can decrease when the linear compressor 100 is installed in, for example, the machine room base of the refrigerator.

In an embodiment of the present disclosure, it can be understood that the axial direction (or axially) means the horizontal direction based on FIG. 1, and the radial direction (or radially) means the vertical direction based on FIG. 1. In addition, it can be understood that the front means the left direction based on FIG. 1, and the rear means the right direction based on FIG. 1.

A longitudinal central axis of the shell 110 coincides with a central axis of the linear compressor 100 to be described below, and the central axis of the linear compressor 100 coincides with a central axis of the cylinder 200 and the piston 300 of the linear compressor 100.

A terminal (not shown) may be installed on an outer surface of the shell 110. The terminal may transmit external electric power to the drive unit 400 of the linear compressor 100. More specifically, the terminal may be connected to a lead line of a coil wound on an outer stator 440.

The linear compressor 100 may include a plurality of pipes 114 and 115 that are included in the shell 110 and can suck, discharge, or inject the refrigerant.

The plurality of pipes 114 and 115 may include an intake pipe 114 that allows the refrigerant to be sucked into the linear compressor 100, and a loop pipe 115 that allows the compressed refrigerant to be discharged from the linear compressor 100.

For example, the intake pipe 114 may be coupled to a rear of the shell 110. The refrigerant may be sucked into the linear compressor 100 along the axial direction through the intake pipe 114. The loop pipe 115 may be coupled to a front of the shell 110. The refrigerant sucked through the intake pipe 114 may be compressed while flowing in the axial direction. The compressed refrigerant may be discharged through the loop pipe 115. The intake pipe 114 may be coupled to a rear of the lower shell, and the loop pipe 115 may be coupled to a front of the lower shell. The loop pipe 115 may be disposed below the intake pipe 114.

The linear compressor 100 may include a bearing means for reducing a friction between the cylinder 200 and the piston 300. The bearing means may be an oil bearing or a gas bearing. Alternatively, a mechanical bearing may be used as the bearing means.

The main body of the linear compressor 100 may be elastically supported by support springs 120 and 140 installed on a lower inner side of the shell 110. The support springs 120 and 140 may include a front support spring 120 for supporting a front of the main body and a rear support spring 140 for supporting a rear of the main body. The support springs 120 and 140 may include a coil spring. The support springs 120 and 140 can absorb vibrations and impacts generated by a reciprocating motion of the piston 300 while supporting internal components of the main body of the linear compressor 100.

The frame 520 may include a body portion 522 supporting an outer circumferential surface of the cylinder 200, and a first flange portion 524 that is connected to one side of the body portion 522 and supports the drive unit 400. The frame 520 may be elastically supported with respect to the shell 110 by the support springs 120 and 140 together with the drive unit 400 and the cylinder 200.

The body portion 522 may wrap the outer circumferential surface of the cylinder 200. The body portion 522 may be formed in a cylindrical shape. The first flange portion 524 may radially extend from a front end of the body portion 522.

The cylinder 200 may be coupled to an inner circumferential surface of the body portion 522. The body portion 522 may be penetrated by an inner stator 420. For example, the cylinder 200 may be press-fitted and fixed to the inner circumferential surface of the body portion 522, and the inner stator 420 may pass through the body portion 522 and may be fixed to the outer circumferential surface of the cylinder 200.

An outer stator 440 may be coupled to a rear surface of the first flange portion 524, and a discharge cover 640 may be coupled to a front surface of the first flange portion 524. For example, the outer stator 440 and the discharge cover 640 may be fixed through a mechanical coupling means.

In an outer circumferential surface of the first flange portion 524, an oil hole forming a part of the oil bearing may be formed, and a first bearing communication hole penetrating from a bearing inlet groove to the inner circumferential surface of the body portion 522 may be formed. The first bearing communication hole may communicate with a second bearing communication hole of the cylinder 200. The first bearing communication hole and the second bearing communication hole may be formed to be inclined toward the inner circumferential surface of the cylinder 200. The second bearing communication hole of the cylinder 200 may communicate with an oil groove formed in the inner circumferential surface of the cylinder 200. The oil groove of the cylinder 200 may be formed in an annular shape having a predetermined depth and a predetermined axial length in the inner circumferential surface of the cylinder 200.

An oil O stored in a bottom surface of the shell 110 through an oil feeder 1000 may sequentially pass through the oil hole, the first bearing communication hole, the second bearing communication hole, and the oil groove and may be supplied between the inner circumferential surface of the cylinder 200 and an outer circumferential surface of the piston 300.

The frame 520 and the cylinder 200 may be formed of aluminum or an aluminum alloy material.

The cylinder 200 may be formed in a cylindrical shape in which both ends are opened. The piston 300 may be inserted through a rear end of the cylinder 200. A front end of the cylinder 200 may be closed via the discharge cover 640.

A discharge valve 620 may be disposed between a front end of the piston 300, the discharge cover 640, and the cylinder 200. A compression space P may be formed between the front end of the piston 300, the discharge valve 620, and the cylinder 200. Here, the front end of the piston 300 may be referred to as a head portion. The volume of the compression space P may increase when the piston 300 moves backward, and may decrease as the piston 300 moves forward. That is, the refrigerant introduced into the compression space P may be compressed while the piston 300 moves forward, and may be discharged through the discharge valve 620.

The cylinder 200 may include a second flange portion disposed at its front end. The second flange portion may bend to the outside of the cylinder 200. The second flange portion may extend in an outer circumferential direction of the cylinder 200. The second flange portion of the cylinder 200 may be coupled to the frame 520.

An oil bearing means may be provided to supply the oil to a gap between the outer circumferential surface of the piston 300 and the inner circumferential surface of the cylinder 200 and to lubricate between the cylinder 200 and the piston 300 with the oil. The oil between the cylinder 200 and the piston 300 may reduce a friction generated between the piston 3M) and the cylinder 200.

The piston 300 is inserted into the opened end at the rear of the cylinder 200 and is provided to seal the rear of the compression space P.

The piston 300 may include a head portion and a guide portion. The head portion may be formed in a disc shape. The head portion may be partially open. The head portion may partition the compression space P. The guide portion may extend rearward from an outer circumferential surface of the head portion. The guide portion may be formed substantially in a cylindrical shape. The inside of the guide portion may be empty, and a front of the guide portion may be partially sealed by the head portion. A rear of the guide portion may be opened and connected to a muffler unit 700. The head portion may be provided as a separate member coupled to the guide portion. Alternatively, the head portion and the guide portion may be integrally formed as one body.

The piston 300 may include an intake port. The intake port may pass through the head portion. The intake port may extend in an axial direction of the piston 300. The intake port may communicate an intake space inside the piston 300 with the compression space P. For example, the refrigerant flowing and introduced into the intake space inside the piston 300 may pass through the intake port and may be sucked into the compression space P between the piston 300 and the cylinder 200.

The plurality of intake ports may be provided along one or more directions of a radial direction and a circumferential direction of the head portion.

The head portion of the piston 300 adjacent to the compression space P may be provided with an intake valve 310 for selectively opening and closing the intake port. The intake valve 310 may operate by elastic deformation to open or close the intake port. That is, the intake valve 310 may pass through the intake port and may be elastically deformed to open the intake port by a pressure of the refrigerant flowing into the compression space P.

The piston 300 may be connected to a permanent magnet 460. The piston 300 may reciprocate forward and backward in response to the movement of the permanent magnet 460. The inner stator 420 and the cylinder 200 may be disposed between the permanent magnet 460 and the piston 300. The permanent magnet 460 and the piston 300 may be connected to each other by a magnet frame 480 formed by detouring the cylinder 200 and the inner stator 420 to the rear.

The muffler unit 700 may be coupled to the rear of the piston 300 and can reduce noise generated in the process of introducing the refrigerant into the piston 300. The refrigerant sucked through the intake pipe 114 may flow into the intake space 102 in the piston 300 via the muffler unit 700.

A discharge valve spring 630 may be provided at a front side of the discharge valve 620 and may elastically support the discharge valve 620. The discharge valve 620 may selectively discharge the compressed refrigerant in the compression space P. Here, the compression space P means a space between the intake valve 310 and the discharge valve 620.

The discharge valve 620 may be disposed to be supportable on the cylinder 200. The discharge valve 620 may selectively open and close a front opening of the cylinder 200. The discharge valve 620 may operate by elastic deformation to open or close the compression space P. The discharge valve 620 may be elastically deformed to open the compression space P by a pressure of the refrigerant that passes through the compression space P and flows into a discharge space.

The discharge valve spring 630 may be provided between the discharge valve 620 and the discharge cover 640 to provide axially an elastic force. The discharge valve spring 630 may be provided as a compression coil spring, or may be provided as a leaf spring in consideration of an occupied space or reliability.

When the pressure of the compression space P is equal to or greater than a discharge pressure, the discharge valve spring 630 may open the discharge valve 620 while deforming forward, and the refrigerant may be discharged from the compression space P and discharged into a discharge space inside the discharge cover 640. When the discharge of the refrigerant is completed, the discharge valve spring 630 may provide a restoring force to the discharge valve 620 and allow the discharge valve 620 to be closed.

A process of introducing the refrigerant into the compression space P through the intake valve 310 and discharging the refrigerant of the compression space P into the discharge space through the discharge valve 620 is described as follows.

In the process in which the piston 300 linearly reciprocates inside the cylinder 200, when the pressure of the compression space P is equal to or less than a predetermined intake pressure, the intake valve 310 is opened and thus the refrigerant is sucked into the compression space P. On the other hand, when the pressure of the compression space P exceeds the predetermined intake pressure, the refrigerant of the compression space P is compressed in a state in which the intake valve 310 is closed.

When the pressure of the compression space P is equal to or greater than a predetermined discharge pressure, the discharge valve spring 630 deforms forward and opens the discharge valve 620 connected to the discharge valve spring 630, and the refrigerant is discharged from the compression space P to the discharge space inside the discharge cover 640. When the discharge of the refrigerant is completed, the discharge valve spring 630 provides a restoring force to the discharge valve 620 and allows the discharge valve 620 to be closed, thereby sealing the front of the compression space P.

The discharge cover 640 is installed at the front of the compression space P to form a discharge space 104 for accommodating the refrigerant discharged from the compression space P, and is coupled to the front of the cylinder 200 and/or the frame 520 to reduce noise generated in the process of discharging the refrigerant from the compression space P. The discharge cover 640 may be coupled to the front end of the cylinder 200 while accommodating the discharge valve 620.

An O-ring may be provided between the discharge cover 640 and the front end of the cylinder 200 to suppress the refrigerant in a gasket for thermal insulation and the discharge space from leaking.

The discharge cover 640 may be formed of a thermally conductive material. Therefore, when a high temperature refrigerant is introduced into the discharge cover 640, heat of the refrigerant may be transferred to the shell 110 through the discharge cover 640 and dissipated to the outside of the linear compressor.

The discharge cover 640 may include one discharge cover, or may be arranged so that a plurality of discharge covers sequentially communicates with each other. When the discharge cover 640 includes the plurality of discharge covers, the discharge space may include a plurality of spaces partitioned by the respective discharge covers. The plurality of spaces may be disposed in a front-rear direction and may communicate with each other. Hence, as the refrigerant discharged from the compression space P sequentially passes through the plurality of discharge spaces, a discharge noise can be reduced, and the refrigerant can be discharged to the outside of the shell 110 through the loop pipe 115.

The drive unit 400 may include the outer stator 440 that is disposed between the shell 110 and the frame 520 and surrounds the body portion 522 of the frame 520, the inner stator 420 that is disposed between the outer stator 440 and the cylinder 200 and surrounds the cylinder 200, and the permanent magnet 460 disposed between the outer stator 440 and the inner stator 420. The drive unit 400 may be referred to as a 'linear motor'.

The outer stator 440 may be coupled to the rear of the first flange portion 524 of the frame 520, and the inner stator 420 may be coupled to the outer circumferential surface of the cylinder 200. The inner stator 420 may be spaced apart from the inside of the outer stator 440, and the permanent magnet 460 may be disposed in a space between the outer stator 440 and the inner stator 420.

The outer stator 440 may be provided with a winding coil. The permanent magnet 460 may consist of a single magnet with one pole or may be configured by combining a plurality of magnets with three poles.

The outer stator 440 may include a coil winding body surrounding the axial direction in the circumferential direction, and a stator core laminated while surrounding the coil winding body. The coil winding body may include a hollow cylindrical bobbin and a coil wound in a circumferential direction of the bobbin. Alternatively, the coil winding body may include a bobbin extending to the inside of the stator core and a coil wound on the bobbin. A cross section of the coil may be formed in a circular or polygonal shape and, for example, may have a hexagonal shape. In the stator core, a plurality of lamination sheets may be laminated radially, or a plurality of lamination blocks may be laminated along the circumferential direction.

The front side of the outer stator 440 may be supported by the first flange portion 524 of the frame 520, and the rear side of the outer stator 440 may be supported by a stator cover 540. For example, a front surface of the stator cover 540 may be supported by the outer stator 440, and a rear surface of the stator cover 540 may be coupled to a back cover 560.

The inner stator 420 may be configured by radially laminating a plurality of laminations on the outer circumferential surface of the cylinder 200.

The permanent magnet 460 may be supported as one side of the permanent magnet 460 is coupled to the magnet frame 480. The magnet frame 480 has substantially a cylindrical shape and may be inserted into a space between the outer stator 440 and the inner stator 420. The magnet frame 480 may be coupled to the rear side of the piston 300 and may move together with the piston 300.

As an example, a rear end of the magnet frame 480 may be bent and extended inward radially and may be coupled to the rear of the piston 300.

When a current is applied to the drive unit 400, a magnetic flux may be formed in the winding coil, and an electromagnetic force may occur by an interaction between the magnetic flux formed in the winding coil of the outer stator 440 and a magnetic flux formed by the permanent magnet 460 to move the permanent magnet 460. At the same time as the axially reciprocating movement of the permanent magnet 460, the piston 300 connected to the magnet frame 480 may also axially reciprocate integrally with the permanent magnet 460.

The drive unit 400 and the compression units 200 and 300 may be axially supported by a shaft support spring 800. The shaft support spring 800 may be a coil spring extending in the axial direction or the horizontal direction. A front end of the shaft support spring 800 may support the muffler unit 700 that is seated on a stepped portion of the piston 300, and a rear end of the shaft support spring 800 may be supported by the back cover 560. The shaft support spring 800 may cover an outer diameter of the muffler unit 700.

An operation of the linear compressor 100 described above is as follows.

First, when a current is applied to the drive unit 400, a magnetic flux may be formed in the outer stator 440 by the current flowing in the coil. The magnetic flux formed in the outer stator 440 may generate an electromagnetic force, and the permanent magnet 460 may linearly reciprocate by the generated electromagnetic force. The electromagnetic force may be alternately generated in a direction (forward direction) in which the piston 300 is directed toward a top dead center (TDC) during a compression stroke, and in a direction (rearward direction) in which the piston 300 is directed toward a bottom dead center (BDC) during an intake stroke. That is, the drive unit 400 may generate a thrust which is a force for pushing the permanent magnet 460 and the piston 300 in a moving direction.

The piston 300 linearly reciprocating inside the cylinder 200 may repeatedly increase or reduce the volume of the compression space P.

When the piston 300 moves in a direction (rearward direction) of increasing the volume of the compression space P, a pressure of the compression space P may decrease. Hence, the intake valve 310 mounted in front of the piston 300 is opened, and the refrigerant remaining in the intake space may be sucked into the compression space P along the intake port. The intake stroke may be performed until the piston 300 is positioned in the bottom dead center by maximally increasing the volume of the compression space P.

The piston 300 reaching the bottom dead center may perform the compression stroke while switching its motion direction and moving in a direction (forward direction) of reducing the volume of the compression space P. As the pressure of the compression space P increases during the compression stroke, the sucked refrigerant may be compressed. When the pressure of the compression space P reaches a setting pressure, the refrigerant can be discharged into the discharge space as the discharge valve 620 is pushed out by the pressure of the compression space P. The compression stroke may continue while the piston 300 moves to the top dead center at which the volume of the compression space P is minimized.

As the intake stroke and the compression stroke of the piston 300 are repeated, the refrigerant introduced into the linear compressor 100 through the intake pipe 114 may be introduced into the piston 300 via the muffler unit 700, and the refrigerant in the piston 300 may be introduced into the compression space P in the cylinder 200 during the intake stroke of the piston 300. A flow may be formed in which after the refrigerant of the compression space P is compressed and discharged into the discharge space during the compression stroke of the piston 300, the refrigerant is discharged to the outside of the linear compressor 100 via the loop pipe 115.

Figure 2:
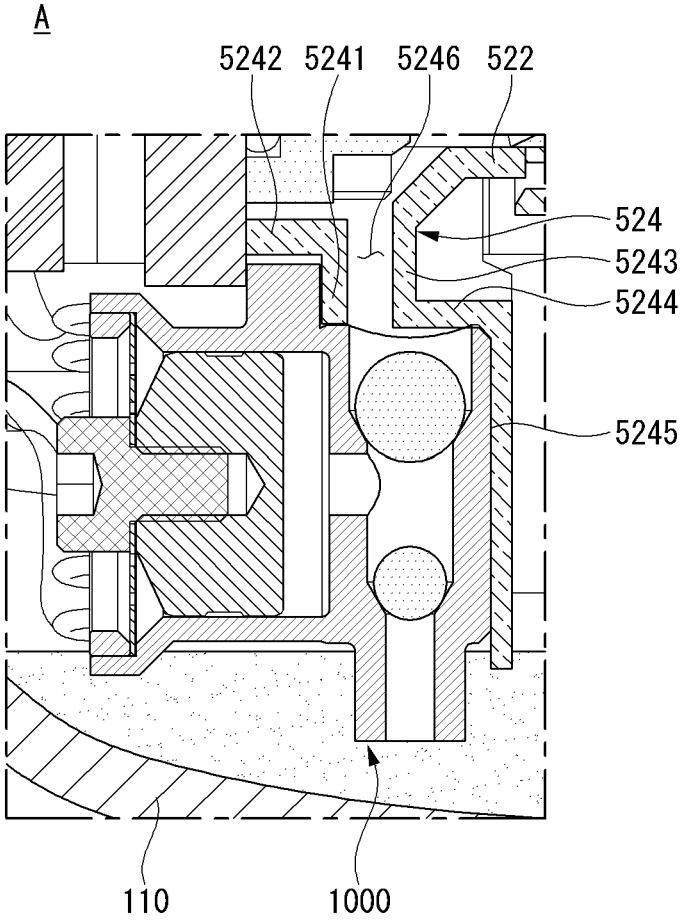
FIG. 2 is an enlarged view of a portion 'A' in FIG. 1.
Figure 3:
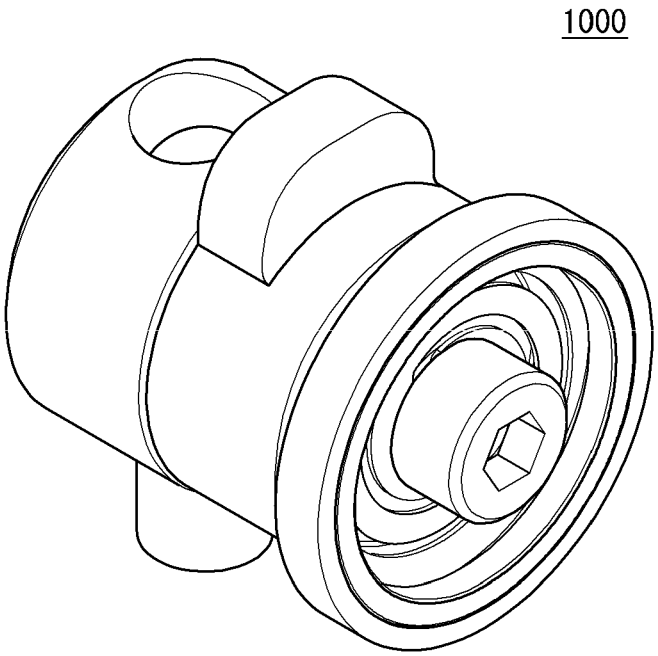
FIG. 3 is a perspective view of an oil feeder according to an embodiment of the present disclosure.
Figure 4:
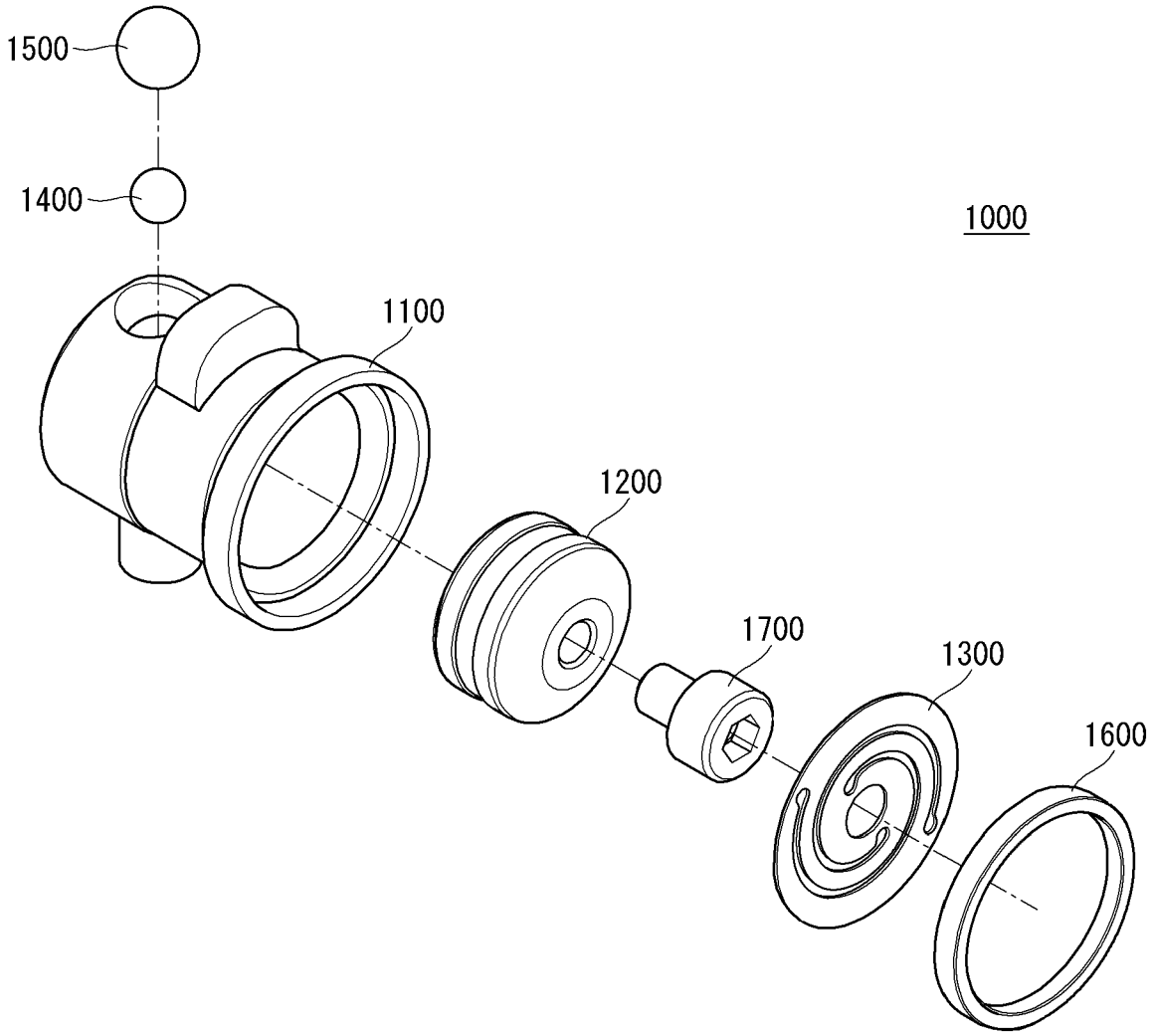
FIG. 4 is an exploded perspective view of an oil feeder according to an embodiment of the present disclosure.
Figure 5:
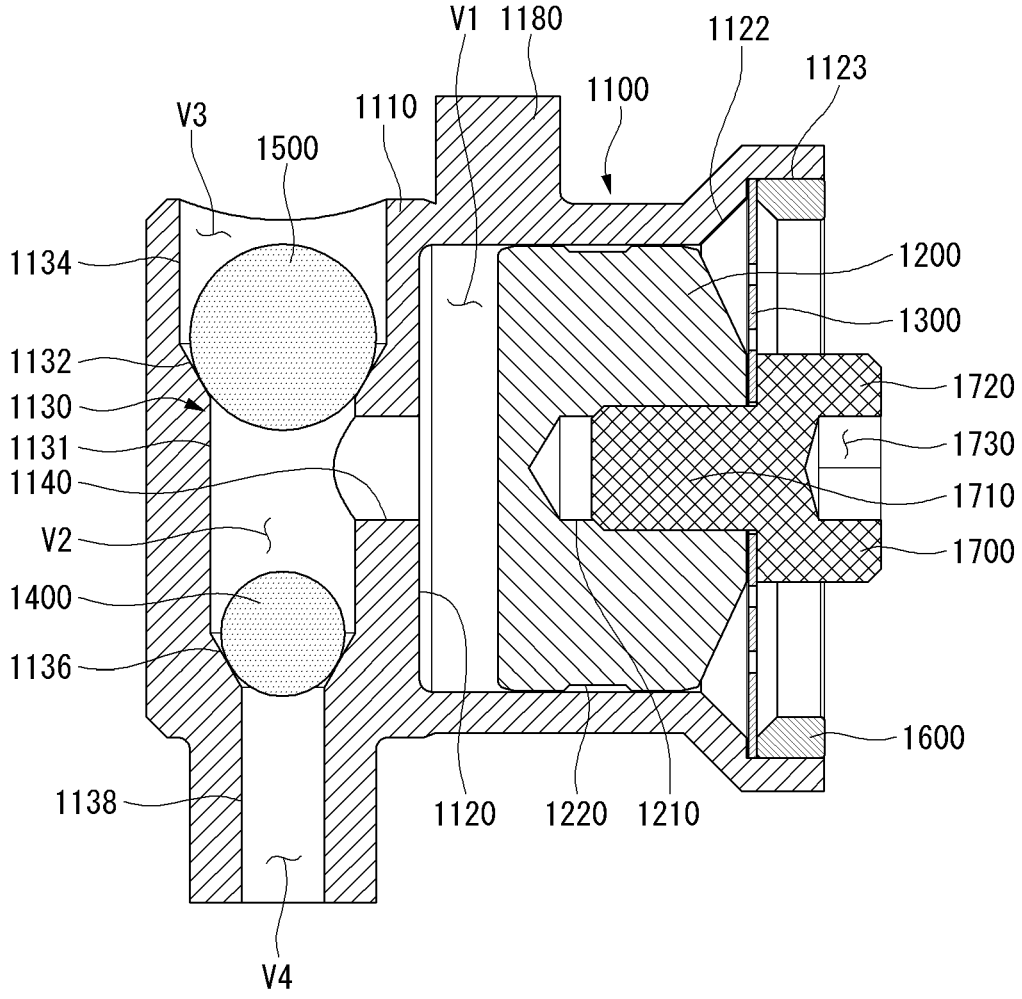
FIG. 5 is a cross-sectional view of an oil feeder according to an embodiment of the present disclosure.

FIG. 2 is an enlarged view of a portion 'A' in FIG. 1. FIG. 3 is a perspective view of an oil feeder according to an embodiment of the present disclosure. FIG. 4 is an exploded perspective view of an oil feeder according to an embodiment of the present disclosure. FIG. 5 is a cross-sectional view of an oil feeder according to an embodiment of the present disclosure.

Referring to FIGS. 2 to 5, an oil feeder 1000 according to an embodiment of the present disclosure may include an oil cylinder 1100, an oil piston 1200, an elastic member 1300, a first ball 1400, a second ball 1500, a fixing member 1600, and a fastening member 1700, but can be implemented except some of these components and does not exclude additional components.

The oil feeder 1000 may be coupled to the frame 520. Specifically, the oil feeder 1000 may be coupled to the first flange portion 524 of the frame 520. Through this, the linear compressor 100 can be made smaller due to a reduction in an axial length of the oil feeder 1000. In this case, the oil feeder 1000 may be fixed to the first flange portion 524 of the frame 520 through an adhesive means such as an adhesive. Alternatively, the oil feeder 1000 may be fixed to the first flange portion 524 of the frame 520 through a mechanical coupling means such as bolting coupling.

The oil feeder 1000 may overlap the outer stator 440 in the axial direction or the horizontal direction. Through this, the space efficiency of the linear compressor 100 can be improved. In this case, the oil feeder 1000 may not overlap the outer stator 440 in the vertical direction. Through this, magnetic interference that may occur when the oil feeder 1000 is disposed below the outer stator 440 can be prevented.

The oil feeder 1000 may vertically overlap the discharge valve 620. Through this, the space efficiency of the linear compressor 100 can be improved.

The first flange portion 524 may include a front portion 5241, a rear portion 5243 disposed at the rear of the front portion 5241, and an oil hole 5246 that is disposed between the front portion 5241 and the rear portion 5243 and communicates with an oil supply hole 1130 of the oil feeder 1000.

The first flange portion 524 may further include a first horizontal portion 5244 extending rearward from an outer end of the rear portion 5243, and a vertical portion 5245 extending from a rear end of the first horizontal portion 5244 radially outward (downward direction with reference to FIG. 2). The first flange portion 524 may further include a second horizontal portion 5242 that extends forward from an inner end of the front portion 5241 and contacts a rear surface of the discharge cover 640.

An upper surface of the oil feeder 1000 may contact an outer end of the front portion 5241 of the first flange portion 524. A rear surface of the oil feeder 1000 may contact a front surface of the rear portion 5243 of the first flange portion 524. Specifically, the rear surface of the oil feeder 1000 may contact a front surface of the vertical portion 5245 of the first flange portion 524. Through this, it is possible to enable the stable coupling of the oil feeder 1000 to the first flange portion 524.

The oil cylinder 1100 may form a main body of the oil feeder 1000. The oil cylinder 1100 may form an appearance of the oil feeder 1000. An oil piston 1200, an elastic member 1300, a first ball 1400, a second ball 1500, a fixing member 1600, and a fastening member 1700) may be disposed in the oil cylinder 1100).

The oil cylinder 1100 may be coupled to the frame 520. The oil cylinder 1100 may be coupled to the first flange portion 524 of the frame 520. Through this, the linear compressor 100 can be made smaller due to a reduction in an axial length of the oil cylinder 1100. In this case, the oil cylinder 1100 may be fixed to the first flange portion 524 of the frame 520 through an adhesive means such as an adhesive. Alternatively, the oil cylinder 1100 may be fixed to the first flange portion 524 of the frame 520 through a mechanical coupling means such as bolting coupling.

The oil cylinder 1100 may overlap the outer stator 440 in the axial direction or the horizontal direction. Through this, the space efficiency of the linear compressor 100 can be improved. In this case, the oil cylinder 1100 may not overlap the outer stator 440 in the vertical direction. Through this, magnetic interference that may occur when the oil cylinder 1100 is disposed below the outer stator 440 can be prevented.

The oil cylinder 1100 may vertically overlap the discharge valve 620. Through this, the space efficiency of the linear compressor 100 can be improved.

An upper surface of the oil cylinder 1100 may contact the outer end of the front portion 5241 of the first flange portion 524. A rear surface of the oil cylinder 1100 may contact the front surface of the rear portion 5243 of the first flange portion 524. Specifically, the rear surface of the oil cylinder 1100 may contact the front surface of the vertical portion 5245 of the first flange portion 524. Through this, it is possible to enable the stable coupling of the oil cylinder 1100 to the first flange portion 524.

The oil cylinder 1100 may include a protrusion 1180 protruding upward from the upper surface. The protrusion 1180 may be inserted into a space between the discharge cover 640 and the front portion 5241. Through this, it is possible to improve the ease of assembly of the oil feeder 1000 by guiding the coupling position of the oil feeder 1000 with respect to the first flange portion 524.

In this case, an upper end of the protrusion 1180 may be disposed adjacent to the second horizontal portion 5242. The upper end of the protrusion 1180 may be vertically spaced apart from the second horizontal portion 5242. Through this, an assembly tolerance between the first flange portion 524 and the oil feeder 1000 can be compensated.

The oil cylinder 1100 may include the oil supply hole 1130. The oil supply hole 1130 may extend in a vertical direction (first direction). The first ball 1400 and the second ball 1500 may be disposed in the oil supply hole 1130. A lower end of the oil supply hole 1130 may contact the oil O stored in the bottom surface of the shell 110. An upper end of the oil supply hole 1130 may communicate with the oil hole 5246 of the first flange portion 524.

The oil supply hole 1130 may include a first oil supply hole 1131 communicating with a communication hole 1140, a second oil supply hole 1138 disposed below the first oil supply hole 1131, a first connection portion 1136 connecting the first oil supply hole 1131 and the second oil supply hole 1138, a third oil supply hole 1134 disposed on the first oil supply hole 1131, and a second connection portion 1132 connecting the first oil supply hole 1131 and the third oil supply hole 1134.

An inner diameter of the second oil supply hole 1138 may be less than an inner diameter of the first oil supply hole 1131. An inner diameter of the first connection portion 1136 may decrease as it goes downward. Through this, the first ball 1400 may be seated on the first connection portion 1136.

An inner diameter of the third oil supply hole 1134 may be greater than the inner diameter of the first oil supply hole 1131. An inner diameter of the second connection portion 1132 may decrease as it goes downward. Through this, the second ball 1500 may be seated on the second connection portion 1132.

The oil cylinder 1100 may include an accommodation groove 1120. The accommodation groove 1120 may be concavely formed at a side surface or a rear surface of the oil cylinder 1100. The oil piston 1200, the elastic member 1300, the fixing member 1600, and the fastening member 1700 may be disposed in the accommodation groove 1120.

The accommodation groove 1120 may include an accommodation space V1 in which the oil piston 1200 is disposed. The accommodation groove 1120 may communicate with the oil supply hole 1130 through the communication hole 1140.

The accommodation groove 1120 may include a coupling area 1123 that is disposed outside the accommodation space V1 and is coupled to an outer portion of the elastic member 1300. An inner diameter of the coupling area 1123 may be greater than an inner diameter of the accommodation space V1. Hence, the present disclosure can improve the structural stability of the oil feeder 1000 by preventing the outer portion of the elastic member 1300 from moving to the accommodation space V1.

The accommodation groove 1120 may include a connection area 1122 connecting the accommodation space V1 and the coupling area 1123.

The oil cylinder 1100 may include the communication hole 1140. The communication hole 1140 may communicate the oil supply hole 1130 with the accommodation groove 1120. The communication hole 1140 may extend horizontally. A horizontal central axis of the communication hole 1140 may be understood to be the same as an axial central axis of the oil piston 1200.

The oil piston 1200 may be disposed in the oil cylinder 1100. The oil piston 1200 may be accommodated in the accommodation groove 1120. The oil piston 1200 may reciprocate in a horizontal direction or an axial direction (second direction) perpendicular to the vertical direction (first direction). Specifically, an outer circumferential surface of the oil piston 1200 may slide in the axial direction with respect to an inner circumferential surface of the oil cylinder 1100.

In an initial state in which the oil feeder 1000 does not operate, the oil piston 1200 may overlap the first ball 1400 and the second ball 1500 in the axial direction. Through this, it is possible to enable the stable vertical movement of the first ball 1400 and the second ball 1500 according to the vibration of the oil piston 1200.

The oil piston 1200 may include a groove 1220 formed on an outer circumferential surface facing an inner wall of the oil cylinder 1100. The groove 1220 may be formed in an annular shape formed along the periphery of the central area on the outer circumferential surface of the oil piston 1200. Hence, the present disclosure can reduce a friction between the oil piston 1200 and the oil cylinder 1100 due to the oil stored in the groove 1220 between the oil piston 1200 and the oil cylinder 1100.

The oil piston 1200 may include a coupling groove 1210 that is concavely formed on a surface or a rear surface facing the elastic member 1300. The coupling groove 1210 may be penetrated by the fastening member 1700 passing through an inner portion of the elastic member 1300. Hence, the present disclosure can improve the ease of assembly of the oil piston 1200 and the elastic member 1300 by assembling the coupling groove 1210 exposed to the outside and the elastic member 1300 using the fastening member 1700.

A rear surface of the oil piston 1200 may be coupled to the elastic member 1300. Specifically, the rear surface of the oil piston 1200 may be coupled to the inner portion of the elastic member 1300. Through this, the oil piston 1200 can be elastically supported in the horizontal direction by the elastic member 1300.

The outer portion of the elastic member 1300 may be coupled to the accommodation groove 1120, and the inner portion of the elastic member 1300 may be coupled to the oil piston 1200. Specifically, the outer portion of the elastic member 13M) may be fixed to the coupling area 1123 of the accommodation groove 1120, and the inner portion of the elastic member 1300 may be fixed to the rear surface of the oil piston 1200. The elastic member 1300 may be a leaf spring. Through this, the oil piston 1200 can be elastically supported in the axial direction with respect to the oil cylinder 1100.

The first ball 1400 may be accommodated in the oil supply hole 1130. The first ball 1400 may be disposed below the communication hole 1140. The first ball 1400 may be seated on the first connection portion 1136. A diameter of the first ball 1400 may be less than the inner diameter of the first oil supply hole 1131. The diameter of the first ball 1400 may be greater than the inner diameter of the second oil supply hole 1138.

The second ball 1500 may be accommodated in the oil supply hole 1130. The second ball 1500 may be disposed on the first ball 1400. The second ball 1500 may be disposed above the communication hole 1140. The second ball 1500 may be seated on the second connection portion 1132. A diameter of the second ball 1500 may be greater than the inner diameter of the first oil supply hole 1131. The diameter of the second ball 1500 may be less than the inner diameter of the third oil supply hole 1134. The diameter of the second ball 1500 may be greater than the diameter of the first ball 1400.

Through this, the present disclosure can improve the ease of assembly of the first ball 1400 and the second ball 1500 with respect to the oil feeder 1000 by inserting the first ball 1400 into the oil supply hole 1130 and then inserting the second ball 1500 into the oil supply hole 1130.

The fixing member 1600 may fix the outer portion of the elastic member 1300 to the oil cylinder 1100. The fixing member 1600 may be formed in an annular ring shape. The fixing member 1600 may be press-fitted and coupled to an inner circumferential surface of the coupling area 1123 of the accommodation groove 1120. Through this, the present disclosure can improve the ease of coupling of the fixing member 1600 to the oil cylinder 1100 while stably fixing the outer portion of the elastic member 1300 to the oil cylinder 1100.

The fastening member 1700 may couple the inner portion of the elastic member 1300 to the oil piston 1200. A fastening portion 1710 of the fastening member 1700 may extend axially, may pass through a central area of the inner portion of the elastic member 1300, and may be coupled to the coupling groove 1210 of the oil piston 1200.

A head portion 1720 of the fastening member 1700 may extend radially from a rear end of the fastening portion 1710. A front end of the head portion 1720 may be seated on the rear surface of the inner portion of the elastic member 1300. The head portion 1720 of the fastening member 1700 may include a tool groove 1730 that is concavely formed from the rear to the front. The tool groove 1730 allows a tool inserted by a user to rotate the fastening member 1700.

Through this, the present disclosure can improve the ease of assembly of the oil piston 1200 and the elastic member 1300 by assembling the coupling groove 1210 exposed to the outside and the elastic member 1300 by the fastening member 1700.

Figure 6:
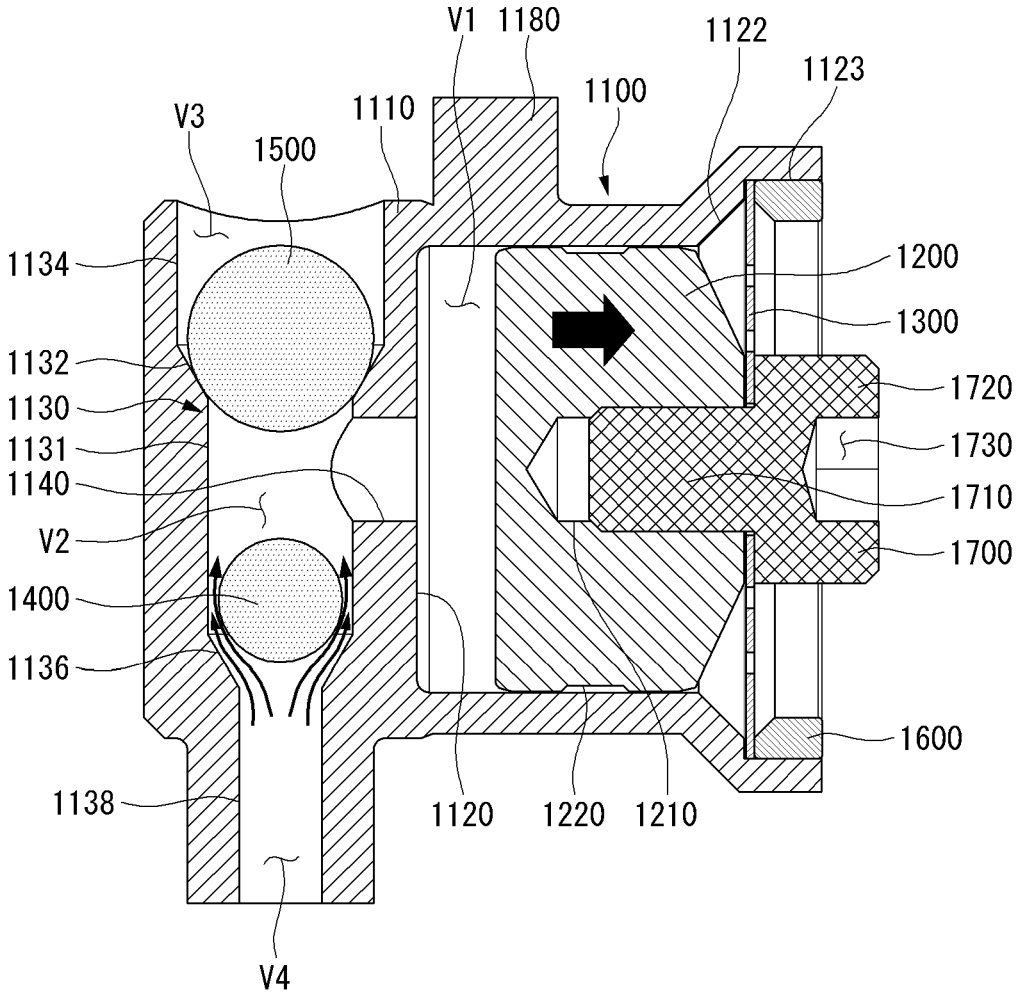
FIGS. 6 and 7 illustrate an operation of an oil feeder according to an embodiment of the present disclosure.
Figure 7:
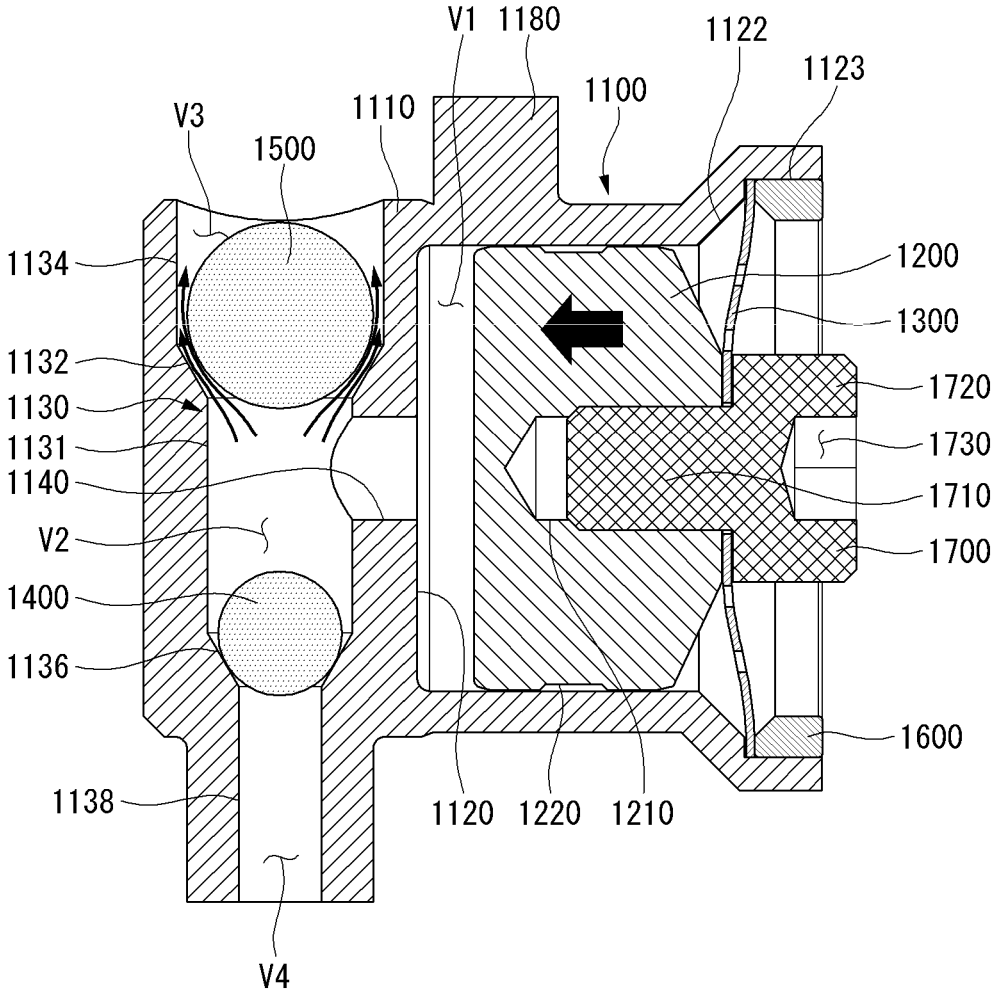

FIGS. 6 and 7 illustrate an operation of an oil feeder according to an embodiment of the present disclosure.

With reference to FIGS. 6 and 7, an operation of the oil feeder 1000 is described.

When the linear compressor 100 is operated, the piston 300 linearly reciprocates in the cylinder 200 to thereby generate vibration in the axial direction in the frame 520. In this case, vibration is transmitted to the oil feeder 1000 connected to the frame 520 in the axial direction, and the oil piston 1200 vibrates in the axial or horizontal direction relative to the oil cylinder 1100.

Referring to FIG. 6, the oil piston 1200 moves rearward in the axial direction with respect to the oil cylinder 1100. In this case, the pressure of the accommodation space V1 is reduced, and the first ball 1400 moves upward. Through this, the oil O stored in the bottom surface of the shell 110 passes through a first oil flow path V4 in the second oil supply hole 1138 and is introduced into a second oil flow path V2 at an upper part of the first oil flow path V4.

Referring to FIG. 7, the oil piston 1200 moves forward in the axial direction with respect to the oil cylinder 1100. In this case, the pressure of the accommodation space V1 increases, and thus the first ball 1400 is seated on the first connection portion 1136 and the second ball 1500 moves upward. Through this, the oil introduced into the second oil flow path V2 passes through a third oil flow path V3 and is introduced into the oil hole 5246.

The oil feeder 1000 according to an embodiment of the present disclosure can reduce the size of the linear compressor 100 by reducing its axial length.

Figure 8:
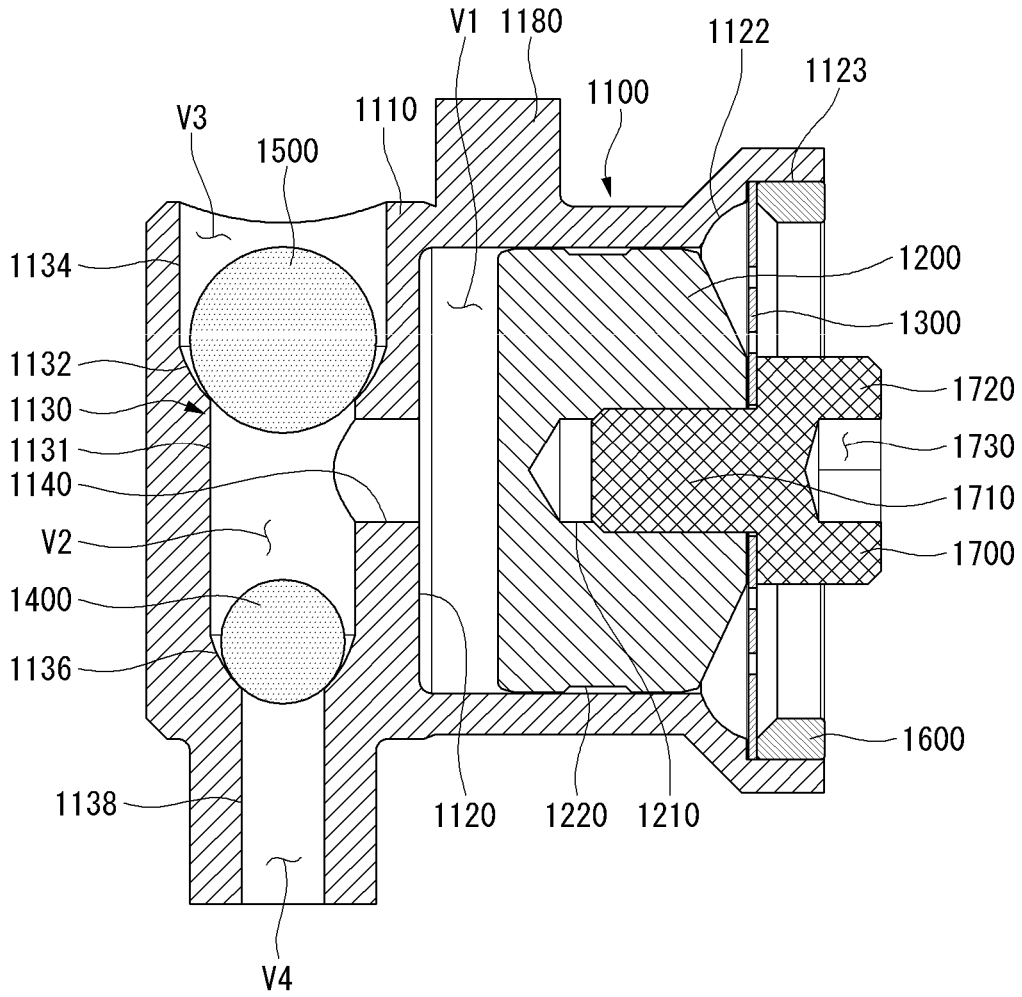
FIGS. 8 and 9 illustrate a modified example of an oil feeder according to an embodiment of the present disclosure.
Figure 9:
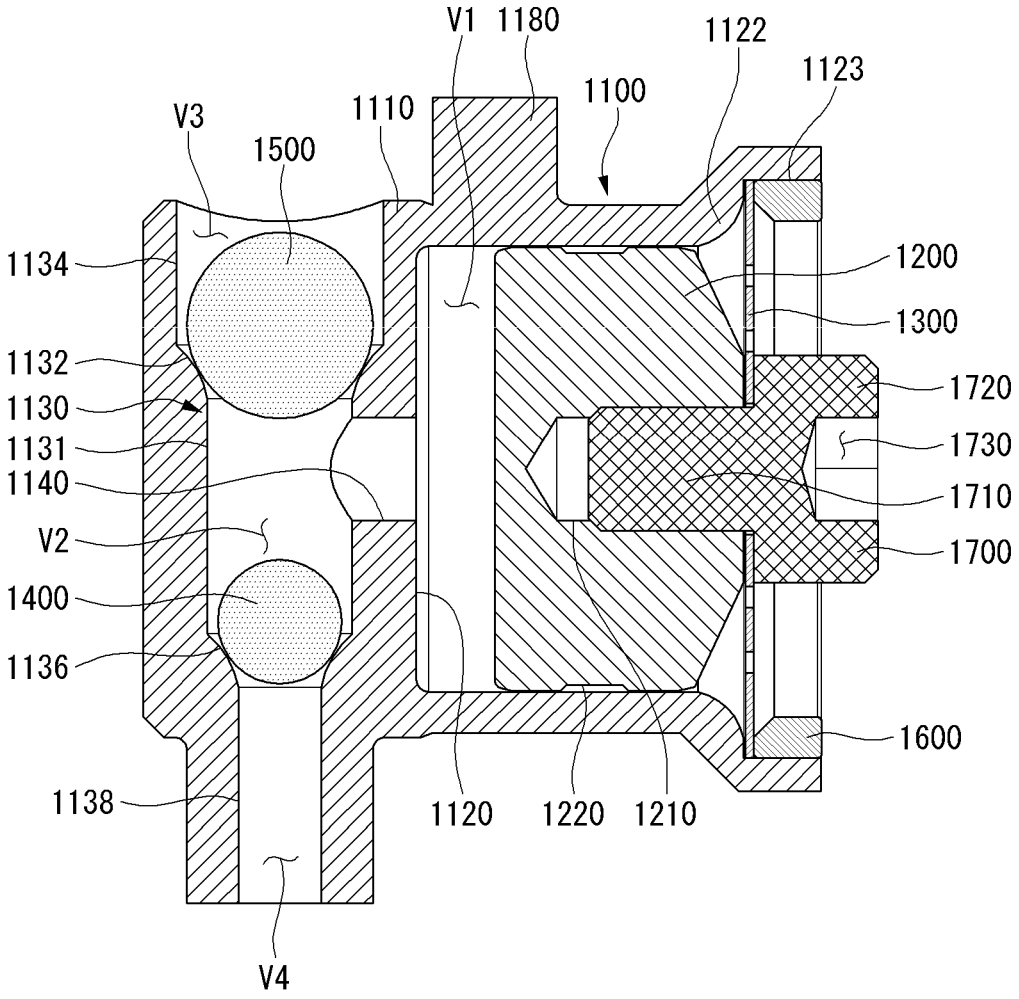
Figure 10:
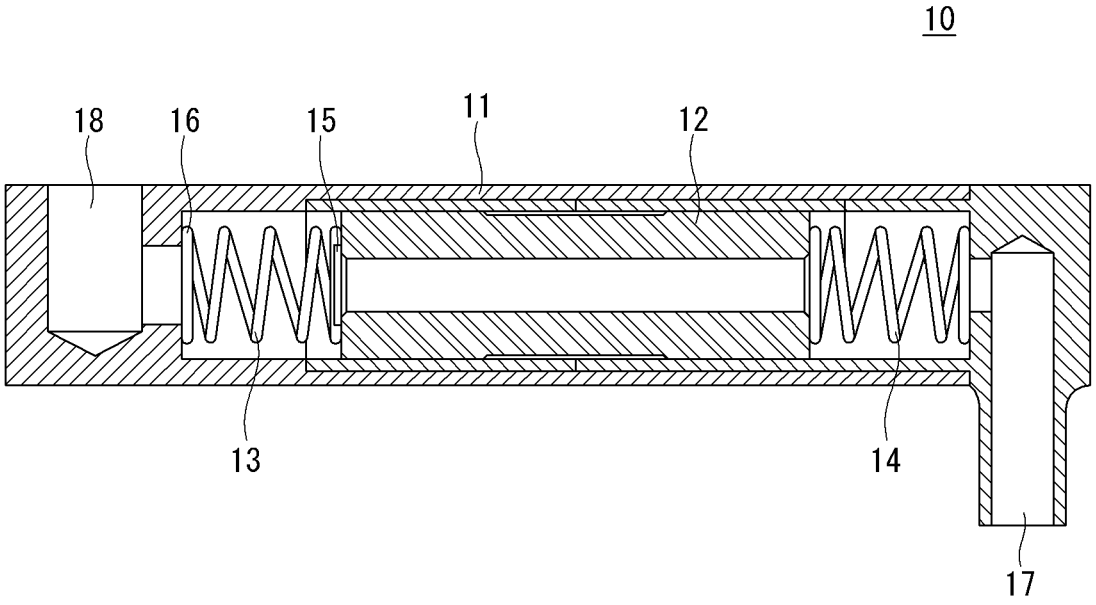
FIG. 10 is a cross-sectional view of an oil feeder according to a related art.

FIGS. 8 and 9 illustrate a modified example of an oil feeder according to an embodiment of the present disclosure.

Referring to FIG. 8, the first connection portion 1136 may be formed concavely inward. Through this, the present disclosure can allow the first ball 1400 to stably move in the vertical direction while stably supporting the first ball 1400.

Further, the second connection portion 1132 may be formed concavely inward. Through this, the present disclosure can allow the second ball 1500 to stably move in the vertical direction while stably supporting the second ball 1500.

The connection area 1122 may be formed concavely inward. Through this, when the elastic member 1300 is deformed due to the vibration of the oil piston 1200, interference between the elastic member 1300 and the connection area 1122 can be reduced.

Referring to FIG. 9, the first connection portion 1136 may be formed to be convex inward. Through this, the oil O stored in the bottom surface of the shell 110 can be smoothly introduced into the second oil flow path V2.

Further, the second connection portion 1132 may be formed to be convex inward. Through this, the oil introduced into the second oil flow path V2 can be smoothly introduced into the oil hole 5246.

Further, the connection area 1122 may be formed to be convex inward. Through this, when the elastic member 1300 is deformed due to the vibration of the oil piston 1200, the present disclosure can guide a deformed area of the elastic member 1300 to limit the axial movement of the oil piston 1200 according to the intention of the designer.

Some embodiments or other embodiments of the present disclosure described above are not exclusive or distinct from each other. Some embodiments or other embodiments of the present disclosure described above can be used together or combined in configuration or function.

For example, configuration "A" described in an embodiment and/or the drawings and configuration "B" described in another embodiment and/or the drawings can be combined with each other. That is, even if the combination between the configurations is not directly described, the combination is possible except in cases where it is described that it is impossible to combine.

The above detailed description is merely an example and is not to be considered as limiting the present disclosure. The scope of the present disclosure should be determined by rational interpretation of the appended claims, and all variations within the equivalent scope of the present disclosure are included in the scope of the present disclosure.

What is claimed is:

1. An oil feeder comprising:
an oil cylinder defining:
an oil supply hole extending in a first direction,
an accommodation groove, and
a communication hole enabling the oil supply hole to be in fluid communication with the accommodation groove;
an oil piston accommodated at the accommodation groove and configured to reciprocate in a second direction perpendicular to the first direction;
a first ball accommodated at the oil supply hole below the communication hole;
a second ball accommodated at the oil supply hole above the communication hole; and
an elastic member comprising (i) an outer portion coupled to the accommodation groove and (ii) an inner portion coupled to the oil piston,
wherein the oil supply hole comprises:
a first oil supply hole being in fluid communication with the communication hole,
a second oil supply hole disposed below the first oil supply hole and having an inner diameter smaller than an inner diameter of the first oil supply hole, and
a third oil supply hole disposed above the first oil supply hole and having an inner diameter larger than the inner diameter of the first oil supply hole.

2. The oil feeder of claim 1, wherein the oil piston defines a groove at an outer circumferential surface of the oil piston that faces an inner wall of the oil cylinder.

3. The oil feeder of claim 1, wherein the oil supply hole comprises a first connection portion connecting the first oil supply hole to the second oil supply hole, the first connection portion being configured to contact the first ball.

4. The oil feeder of claim 3, wherein the first connection portion has a decreasing inner diameter in a downward direction and includes a concave portion.

5. The oil feeder of claim 1, wherein the oil supply hole comprises a second connection portion connecting the first oil supply hole to the third oil supply hole, the second connection portion being configured to contact the second ball.

6. The oil feeder of claim 5, wherein the second connection portion has a decreasing inner diameter in a downward direction and includes a concave portion.

7. The oil feeder of claim 1, wherein the accommodation groove comprises:
an accommodation space configured to receive the oil piston; and
a coupling area that is disposed outside the accommodation space and is coupled to the outer portion of the elastic member, and
wherein an inner diameter of the coupling area is larger than an inner diameter of the accommodation space.

8. The oil feeder of claim 7, wherein the accommodation groove comprises a connection area configured to connect the accommodation space and the coupling area, and
wherein the connection area includes a concave portion.

9. An oil feeder comprising:
an oil cylinder defining:
an oil supply hole extending in a first direction,
an accommodation groove, and
a communication hole enabling the oil supply hole to be in fluid communication with the accommodation groove;
an oil piston accommodated at the accommodation groove and configured to reciprocate in a second direction perpendicular to the first direction;
a first ball accommodated at the oil supply hole below the communication hole;
a second ball accommodated at the oil supply hole above the communication hole; and
an elastic member comprising (i) an outer portion coupled to the accommodation groove and (ii) an inner portion coupled to the oil piston,
wherein a diameter of the first ball is smaller than a diameter of the second ball.

10. An oil feeder comprising:
an oil cylinder defining:
an oil supply hole extending in a first direction,
an accommodation groove, and
a communication hole enabling the oil supply hole to be in fluid communication with the accommodation groove;
an oil piston accommodated at the accommodation groove and configured to reciprocate in a second direction perpendicular to the first direction;
a first ball accommodated at the oil supply hole below the communication hole;
a second ball accommodated at the oil supply hole above the communication hole; and
an elastic member comprising (i) an outer portion coupled to the accommodation groove and (ii) an inner portion coupled to the oil piston,
wherein the first ball and the second ball are configured to, based on the oil feeder not being operated, overlap the oil piston in the second direction.

11. An oil feeder comprising:
an oil cylinder defining:
an oil supply hole extending in a first direction,
an accommodation groove, and
a communication hole enabling the oil supply hole to be in fluid communication with the accommodation groove;
an oil piston accommodated at the accommodation groove and configured to reciprocate in a second direction perpendicular to the first direction;
a first ball accommodated at the oil supply hole below the communication hole;
a second ball accommodated at the oil supply hole above the communication hole; and
an elastic member comprising (i) an outer portion coupled to the accommodation groove and (ii) an inner portion coupled to the oil piston,
wherein the oil piston defines a coupling groove at a surface facing the elastic member, and
wherein a fastening member extends through the inner portion of the elastic member and the coupling groove.

12. An oil feeder comprising:
an oil cylinder defining:
an oil supply hole extending in a first direction,
an accommodation groove, and
a communication hole enabling the oil supply hole to be in fluid communication with the accommodation groove;
an oil piston accommodated at the accommodation groove and configured to reciprocate in a second direction perpendicular to the first direction;
a first ball accommodated at the oil supply hole below the communication hole;
a second ball accommodated at the oil supply hole above the communication hole;
an elastic member comprising (i) an outer portion coupled to the accommodation groove and (ii) an inner portion coupled to the oil piston; and
a fixing member fixing the outer portion of the elastic member to the oil cylinder,
wherein the fixing member is press-fitted to the accommodation groove.

13. A linear compressor comprising:
a shell;
a frame disposed in the shell, the frame comprising a body portion and a flange portion extending radially from a front area of the body portion;
a cylinder fixed to the body portion;
a piston disposed in the cylinder and configured to reciprocate axially;
a discharge valve coupled to the cylinder and disposed at a front of the piston; and
an oil feeder coupled to the flange portion and configured to supply oil stored in a bottom surface of the shell to a space defined by the cylinder and the piston,
wherein the oil feeder comprises:
an oil cylinder defining:
an oil supply hole extending in a first direction,
an accommodation groove, and
a communication hole enabling the oil supply hole to be in fluid communication with the accommodation groove,
an oil piston accommodated at the accommodation groove and configured to reciprocate in a second direction perpendicular to the first direction,
a first ball accommodated at the oil supply hole and disposed below the communication hole,
a second ball accommodated at the oil supply hole and disposed above the communication hole, and
an elastic member comprising (i) an outer portion coupled to the accommodation groove and (ii) an inner portion coupled to the oil piston, and
wherein the oil feeder overlaps the discharge valve in the first direction.

14. The linear compressor of claim 13, further comprising:
an inner stator fixed to an outer circumferential surface of the cylinder;
an outer stator fixed to a rear surface of the flange portion; and
a permanent magnet disposed between the inner stator and the outer stator and connected to the piston,
wherein the oil feeder overlaps the outer stator in the second direction.

15. A linear compressor comprising:
a shell;
a frame disposed in the shell, the frame comprising a body portion and a flange portion extending radially from a front area of the body portion;
a cylinder fixed to the body portion;
a piston disposed in the cylinder and configured to reciprocate axially; and
an oil feeder coupled to the flange portion and configured to supply oil stored in a bottom surface of the shell to a space defined by the cylinder and the piston,
wherein the oil feeder comprises:
an oil cylinder defining:
an oil supply hole extending in a first direction,
an accommodation groove, and
a communication hole enabling the oil supply hole to be in fluid communication with the accommodation groove,
an oil piston accommodated at the accommodation groove and configured to reciprocate in a second direction perpendicular to the first direction,
a first ball accommodated at the oil supply hole and disposed below the communication hole,
a second ball accommodated at the oil supply hole and disposed above the communication hole, and
an elastic member comprising (i) an outer portion coupled to the accommodation groove and (ii) an inner portion coupled to the oil piston,
wherein the flange portion comprises:
a front portion,
a rear portion disposed at a rear of the front portion, and
an oil hole disposed between the front portion and the rear portion and being in fluid communication with the oil supply hole,
wherein an upper surface of the oil cylinder contacts an outer end of the front portion, and
wherein a rear surface of the oil cylinder contacts a front surface of the rear portion.

16. The linear compressor of claim 15, wherein the flange portion comprises:
a first horizontal portion extending rearward from an outer end of the rear portion, and
a vertical portion extending radially outward from a rear end of the first horizontal portion, and
wherein the rear surface of the oil cylinder contacts a front surface of the vertical portion.

17. The linear compressor of claim 15, further comprising:

a discharge cover coupled to a front end of the cylinder, wherein the oil cylinder comprises a protrusion that protrudes upward from the upper surface of the oil cylinder, and wherein the protrusion is inserted into a space between the discharge cover and the front portion.

18. The linear compressor of claim 17, wherein the flange portion comprises a second horizontal portion extending forward from an inner end of the front portion and contacting a rear surface of the discharge cover, and wherein an upper end of the protrusion is disposed adjacent to the second horizontal portion.

* * * * *